US006915264B2

(12) United States Patent
Baumgarte

(10) Patent No.: US 6,915,264 B2
(45) Date of Patent: Jul. 5, 2005

(54) COCHLEAR FILTER BANK STRUCTURE FOR DETERMINING MASKED THRESHOLDS FOR USE IN PERCEPTUAL AUDIO CODING

(75) Inventor: Frank Baumgarte, North Plainfield, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 768 days.

(21) Appl. No.: 09/791,228

(22) Filed: Feb. 22, 2001

(65) Prior Publication Data

US 2002/0147595 A1 Oct. 10, 2002

(51) Int. Cl.[7] ..... G10L 21/00

(52) U.S. Cl. ..... 704/500; 704/200.1; 704/504; 708/300

(58) Field of Search ..... 704/500, 504, 704/200.1, 205; 708/300, 312; 324/76.31

(56) References Cited

U.S. PATENT DOCUMENTS

| | | | | | |
|---|---|---|---|---|---|
| 4,459,542 | A | * | 7/1984 | Terrier et al. | 324/76.31 |
| 4,896,356 | A | * | 1/1990 | Millar | 704/205 |
| 5,138,569 | A | * | 8/1992 | Valenzuela | 708/312 |
| 5,394,473 | A | * | 2/1995 | Davidson | 704/200.1 |
| 5,623,577 | A | * | 4/1997 | Fielder | 704/200.1 |
| 5,841,681 | A | * | 11/1998 | Chen et al. | 708/300 |
| RE36,714 | E | | 5/2000 | Brandenburg et al. | 704/227 |

OTHER PUBLICATIONS

ISO/IEC JTC1/SC29/WG11 "Coding of moving pictures and audio—MPEG–2 Advanced Audio Coding", *ISO/IEC 13818–7 International Standard*, Annex B, Section 2.1, (1997).

ITU–R "Method of objective measurement of perceived audio quality," *Rec. ITU–R BS.1387*, Annex 2, Section 2.2, Geneva (1998).

Baumgarte, F. "Evaluation of a Physiological Ear Model Considering Masking Effects Relevant to Audio Coding", *105th AES Convention*, San Francisco, CA, Preprint 4789 (1998).

Hall, J.L., "Asymmetry of masking revisited: Generalization of masker and probe bandwidth", *J Acoust. Soc. Am.*, 101(2), 1023–1033 (1997).

Ruggero, M.A. et al., "Basilar–membrane responses to tones at the base of the chinchilla cochlea", *J. Acoust. Soc. Am.*, 101(4), 2151–2163, (1997).

Edler, B. et al., "Audio Coding Using a Psycho–acoustic pre– and postfilter", *Proc. ICASSP*, Istanbul, (2000).

(Continued)

*Primary Examiner*—Susan McFadden
*Assistant Examiner*—Huyen X. Vo
(74) *Attorney, Agent, or Firm*—Kenneth M. Brown

(57) ABSTRACT

A method and apparatus for determining masked thresholds for a perceptual auditory model used, for example, in a perceptual audio coder, which makes use of a filter bank structure comprising a plurality of filter bank stages which are connected in series, wherein each filter bank stage comprises a plurality of low-pass filters connected in series and a corresponding plurality of high-pass filters applied to the outputs of each of the low-pass filters, and wherein downsampling is advantageously applied between each successive pair of filter bank stages. In accordance with one illustrative embodiment, the filter bank comprises low order IIR filters. The cascade structure advantageously supports sampling rate reduction due to the continuously decreasing cutoff frequency in the cascade. The filter bank coefficients may advantageously be optimized for modeling of masked threshold patterns of narrow-band maskers, and the generated thresholds may be advantageously applied in a perceptual audio coder.

52 Claims, 4 Drawing Sheets

OTHER PUBLICATIONS

Baumgarte, F., "A Physiological Ear Model for Auditory Masking Applicable to Perceptual Coding", *Presented at the 103rd AES Convention*, Preprint No. 4511, New York, (1997).

Baumgarte, F., "A Physiological Ear Model for Specific Loudness and Masking", *Proc. Workshop on Applications of Sig. Proc. To Audio and Acoustics*, New Paltz, (1997).

Kates, J.M., "A Time–Domain Digital Cochlear Model", *IEEE Trans. On Signal Processing*, vol. 39, No. 12, pp. 2573–2592 (1991).

Lyon, R.F., "All–Pole Models Of Auditory Filtering", *preprint from* dicklyon@acm.org. *published in Diversity in Auditory Mechanics*, Lewis et al., (eds.), pp. 205–211 (1997).

* cited by examiner

COCHLEAR FILTER BANK STRUCTURE FOR DETERMINING MASKED THRESHOLDS FOR USE IN PERCEPTUAL AUDIO CODING

FIELD OF THE INVENTION

The present invention relates generally to the field of perceptual audio coding (PAC) and more particularly to a computationally efficient filter bank structure for use in determining masked thresholds for use therein.

BACKGROUND OF THE INVENTION

For compression of audio signals as well as for automatic audio quality assessment, perceptional models are typically employed to estimate the audibility of signal distortions. (See, e.g., U.S. Pat. No. RE36714, "Perceptual Coding of Audio Signals", issued to K. Brandenburg et al. U.S. Pat. No. RE36714, which is commonly assigned to the assignee of the present invention, is hereby incorporated by reference as if fully set forth herein.) Typical realizations of such a perceptual model are also described, for example, in various standards for audio coding (See, e.g., ISO/IEC JTC1/SC29/WG11, "Coding of Moving Pictures and Audio—MPEG-2 Advanced Audio Coding AAC", ISO/IEC 13818-7 International Standard, 1997.) and in certain standards for audio quality assessment (See, e.g., ITU-R, "Method for Objective Measurement of Perceived Audio Quality," Rec. ITU-R BS.1387, Geneva, 1998.), each of which are fully familiar to those of ordinary skill in the art.

A crucial part of these perceptual models is the spectral decomposition of the acoustic signal into band-pass signals. In perceptual audio coding applications, for example, the audio signal is treated as a masker for distortions introduced by lossy data compression. For this purpose, the masked thresholds are approximated by a perceptual model. As a first processing step, a spectral decomposition of the acoustic signal is performed so that a set of masked thresholds corresponding to the various frequency ranges may be derived.

In particular, a spectral decomposition used for this purpose should advantageously mimic the corresponding properties of the human auditory system—specifically, the frequency selectivity and temporal resolution which results from the corresponding spectral decomposition process which is part of the signal processing performed inside the human cochlea. The cochlea provides band-pass filtered versions of the input signal that are subsequently transduced into neural signals by the inner hair cells. The associated band-pass filters have increasing bandwidth with increasing center frequency and an asymmetric frequency response. However, currently used spectral decomposition schemes for masking modeling in audio coding or audio quality assessment, for example, generally do not achieve the non-uniform time and frequency resolution provided by the cochlea. These applications rather take advantage of the computational efficiency of uniform filter banks or transforms at the expense of coding gain.

As is well known to those of ordinary skill in the art, a time-to-frequency transform is one very efficient way to compute a spectral decomposition. For example, the perceptual models in both the above referenced MPEG-2 audio coding standard and in the basic version of the above referenced quality assessment standard each use the Fast Fourier Transform (FFT), which is fully familiar to those of ordinary skill in the art. The FFT provides constant spectral and temporal resolution over frequency. However, the auditory filters of the cochlea have increasing bandwidth and temporal resolution with increasing center frequency. This non-uniform spectral resolution of the auditory system is usually taken into account by summing up the energies of an appropriate number of neighboring FFT frequency bands. However, the phase relation between spectral components within an auditory filter band is not taken into account by such a summation of energies. And the temporal resolution of the spectral decomposition is determined by the transform size and is thus constant across all auditory bands. This results in a significantly lower temporal resolution at high center frequencies in comparison with the corresponding auditory filters. These deviations lead to inaccurate modeling of masking and sub-optimal coding gain.

The "Advanced Model" of the above referenced quality assessment standard, on the other hand, replaces the FFT by a filter bank of band-pass filters which have a larger bandwidth at higher center frequencies. More specifically, each of a set of 40 critical band filter pairs is realized as a Finite Impulse Response (FIR) filter, wherein the output of each filter pair is a critical band signal and its (90 degree phase shifted) Hilbert transform, which is advantageously downsampled by a factor of 32. (FIR filters and Hilbert transforms are both fully familiar to those of ordinary skill in the art.) The appropriate auditory filter slopes are created by spectral convolution with a spreading function. This complex convolution advantageously increases the temporal resolution of the original filters, but the filter bank is computationally complex and the linear phase response is not in line with the auditory system. Furthermore, the downsampling can create aliasing distortions in the high frequency bands.

For the above reasons, it would be highly desirable to provide a spectral decomposition scheme which provides improved masking modeling for perceptual audio coding applications (for example), and which does so at relatively low computational costs. In particular, it would be desirable to provide a method and apparatus for performing a spectral decomposition which is suitable for achieving the time and frequency resolution necessary to simulate psychophysical data closely related to cochlear spectral decomposition properties, and which overcomes the drawbacks of prior art approaches.

SUMMARY OF THE INVENTION

In accordance with the principles of the present invention, a novel filter bank structure is provided which can advantageously be employed in place of the FFT based or filter based spectral decomposition methods used in prior art perceptual models. More particularly, this filter bank structure illustratively comprises a low order low-pass filter cascade with downsampling stages and a high-pass filter connected to each low-pass filter output. This structure advantageously results in a computationally efficient implementation of auditory filters since critical downsampling is supported and, moreover, the filter orders can be low without sacrificing accuracy.

For example, in accordance with one illustrative embodiment of the present invention, a 2nd order Infinite Impulse Response (IIR) low-pass filter and a 4th order IIR high-pass filter for each channel is used in a perceptual model. (IIR filters are fully familiar to those of ordinary skill in the art.) Such an illustrative filter bank structure may be advantageously employed in a model for masking in which the filter coefficients have been optimized to match a desired magnitude frequency response derived from known auditory filter measurements.

More specifically, the present invention provides a method and apparatus for determining masked thresholds for a perceptual auditory model which makes use of a novel filter bank structure comprising a plurality of filter bank stages which are connected in series, wherein each filter bank stage comprises a plurality of low-pass filters connected in series and a corresponding plurality of high-pass filters applied to the outputs of each of the low-pass filters, and wherein downsampling is advantageously applied between each successive pair of filter bank stages.

In accordance with one illustrative embodiment of the present invention, a filter bank is provided which consists of a cascade of low order IIR filters. The cascade structure advantageously supports sampling rate reduction due to the continuously decreasing cutoff frequency in the cascade. In accordance with the illustrative embodiment of the present invention, the filter bank coefficients may advantageously be optimized for modeling of masked threshold patterns of narrow-band maskers, and the generated thresholds may be advantageously applied in a perceptual auditory model used in, for example, a perceptual audio coder.

DETAILED DESCRIPTION

Figure 1:
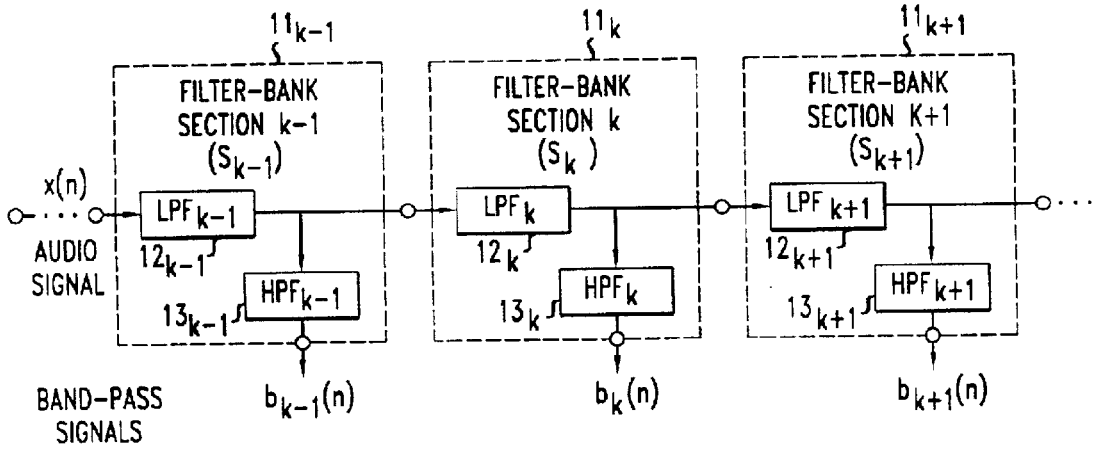
FIG. 1 shows a block diagram of a series of filter bank sections as may be comprised in a filter bank structure in accordance with an illustrative embodiment of the present invention.

FIG. 1 shows a block diagram of a series of filter bank sections as may be comprised in a filter bank structure in accordance with an illustrative embodiment of the present invention. As is known from studies of the human auditory system, the cochlear signal processing performs a spectral analysis of the input acoustic signal with spectrally highly overlapping band-pass filters. The non-uniform frequency resolution and bandwidths of these filters may be advantageously approximated in an illustrative embodiment of the present invention with use of cascaded IIR filters arranged as shown, for example, in FIG. 1.

More specifically, FIG. 1 shows an illustrative filter bank structure which comprises a series of cascaded low-pass filters (LPFs) together with corresponding high-pass filters (HPFs) connected thereto. The LPFs in the cascade advantageously have a decreasing cutoff frequency from left to right in the figure. Each LPF output is connected to the input of a corresponding HPF. The HPF cutoff frequency is advantageously equal to the cutoff frequency of the LPF cascade segment between the filter bank input and the HPF input. Thus, the output of each HPF has a band-pass characteristic with respect to the filter bank input signal. The basic block of one LPF connected to its corresponding HPF, as shown in FIG. 1, is referred to as a filter bank section.

In particular, then, FIG. 1 shows the input audio signal x(n) being fed to a cascade of filter bank sections including filter bank section $\mathbf{11}_{k-1}$, which, in turn, comprises LPF $\mathbf{12}_{k-1}$ and HPF $\mathbf{13}_{k-1}$; filter bank section $\mathbf{11}_k$, which, in turn, comprises LPF $\mathbf{12}_k$ and HPF $\mathbf{13}_k$; and filter bank section $\mathbf{11}_{k+1}$, which, in turn, comprises LPF $\mathbf{12}_{k+1}$ and HPF $\mathbf{13}_{k+1}$. Each of HPFs $\mathbf{13}_{k-1}$, $\mathbf{13}_{k-1}$, and $\mathbf{13}_{k-1}$ produce band-pass signals $b_{k-1}(n)$, $b_k(n)$, and $b_{k+1}(n)$, respectively. As shown in the figure, additional filter bank sections, each comprising a corresponding LPF and HPF connected in the same way, may precede filter bank section $\mathbf{11}_{k-1}$ and/or follow filter bank section $\mathbf{11}_{k+1}$.

Figure 2:
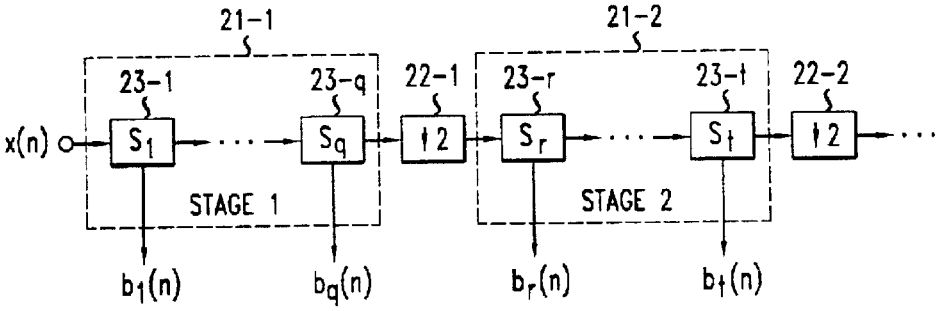
FIG. 2 shows a block diagram of a filter bank structure comprising a series of filter bank stages and downsampling in accordance with an illustrative embodiment of the present invention.

FIG. 2 shows a block diagram of a filter bank structure comprising a series of filter bank stages and downsamplers in accordance with an illustrative embodiment of the present invention. Specifically, the illustrative filter bank structure comprises a series of connected filter bank stages in combination with downsampling modules interconnected in series between each pair of successive filter bank stages. Each filter bank stage comprises a series of connected filter bank sections such as is illustratively shown in FIG. 1.

Note that the decreasing cutoff frequency of the LPF cascade permits a reduction of the sampling rate, which advantageously reduces computational complexity. That is, the illustrative filter bank of FIG. 2 advantageously implements a simple and efficient "stage-wise" sampling rate reduction, wherein each filter bank stage comprises a group of cascaded filter bank sections with equal sampling rate. A rate reduction by a factor of two is illustratively achieved by the downsamplers as shown by simply omitting every second sample at the input to the successive filter bank stage. The downsampling is advantageously applied when the cutoff frequency of the LPF cascade output is below a given ratio with respect to the sampling frequency in that stage to limit aliasing. It will be obvious to those of ordinary skill in the art that in other illustrative embodiments of the present invention a wide variety of sampling rate reduction factors other than 2 may be used.

Specifically, FIG. 2 shows an input audio signal x(n) being fed to a cascade of filter bank stages which includes filter bank stage 21-1. filter bank stage 21-2. etc., and a corresponding series of downsamplers which includes downsampler 22-1, downsampler 22-2, etc., interspersed therebetween. Advantageously, and in accordance with the illustrative embodiment shown in the figure, each of downsamplers 22-1, 22-2; etc. reduce the sampling rate of their corresponding input signal by a factor of two. Filter bank stage 21-1, for example, comprises a series of filter bank sections (as illustratively shown, for example, in FIG. 1) which illustratively comprises filter bank sections 23-1, . . . , 23-q; and filter bank stage 21-2, for example, comprises a series of filter bank sections (also as illustratively shown, for example, in FIG. 1) which illustratively comprises filter bank sections 23-r, . . . , 23-t. Each of the filter bank sections 23-1, . . . , 23-q and 23-r, . . . , 23-t illustratively comprises a corresponding LPF and a corresponding HPF (as illustratively shown in FIG. 1), and produces as an output therefrom a corresponding band-pass signal, $b_l(n)$, . . . , $b_q(n)$ and $b_r(n)$, . . . , $b_t(n)$, respectively.

Although not explicitly shown in the figure, the illustrative embodiment of FIG. 2 may advantageously comprise a number of additional filter bank stages 21-3. 21-4, etc., each of which comprises a corresponding series of filter bank sections, and additional downsamplers 22-3, 22-4, etc., interspersed therebetween. In accordance with one particular illustrative embodiment of the present invention, a total of approximately nine filter bank stages may be advantageously employed, wherein filter bank stage 21-1 consists of approximately 25 filter bank sections and each of the remaining filter bank stages consists of approximately 15 filter bank sections.

In accordance with certain illustrative embodiments of the present invention, the filter orders of all HPFs are advantageously equal and the filter orders of all LPFs are also advantageously equal. In particular, note that the filter orders of the HPFs and LPFs determine the achievable accuracy of the desired frequency response approximation. The LPF and HPF order may be chosen independently and each will advantageously be as small as possible (for purposes of minimizing computational complexity), and yet large enough to accurately model the spectral decomposition features found in the relevant psychophysical data. In accordance with one illustrative embodiment of the present invention, an LPF order of 2 and an HPF order of 4 may be advantageously used. It has been determined that despite the fact that these filter orders are quite low, they are sufficient to model masking in a high quality manner.

The desired magnitude frequency responses of the filters may be advantageously derived from psychophysical masking data. In accordance with various illustrative embodiments of the present invention, once the filter orders have been defined, the filter coefficients may be advantageously determined by a conventional optimization algorithm, which minimizes an error function of the responses of the desired filters and the proposed filter bank. Such optimization algorithms are generally available and their use is fully familiar to those of ordinary skill in the art. The responses of the desired filters may be advantageously derived from psychophysical measurements of the human auditory system, which are also well known to those skilled in the art. (See, e.g., F. Baumgarte, "Evaluation of a Physiological Ear Model Considering Masking Effects Relevant to Audio Coding," 105th AES Convention, San Francisco, Calif., September 1998; F. Baumgarte, "A Physiological Ear Model for Auditory Masking Applicable to Perceptual Coding," 103rd AES Convention, New York, September 1997; and F. Baumgarte, "A Physiological Ear Model for Specific Loudness and Masking," Proc. Workshop on Applications of Sig. Proc. to Audio and Acoustics, New Paltz, October 1997. Each of these background references are incorporated by reference as if fully set forth herein.)

Figure 3:
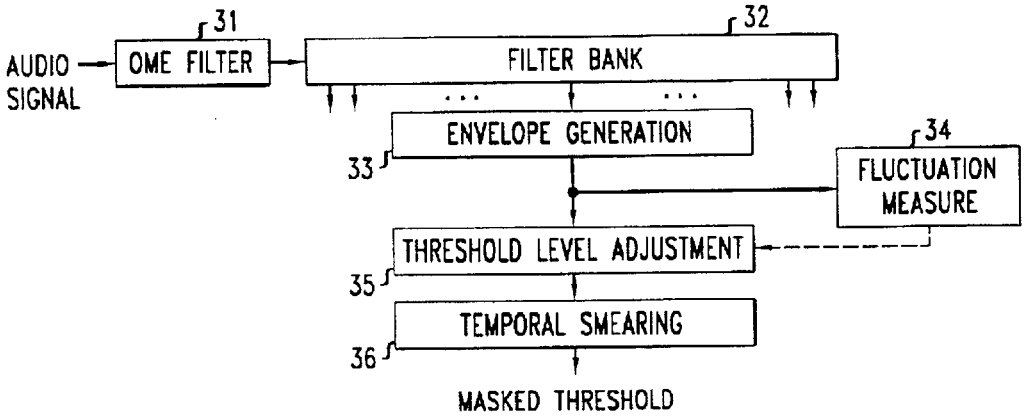
FIG. 3 shows a block diagram of an illustrative apparatus for generating masked thresholds using a filter bank such as the illustrative filter bank of FIG. 2 in accordance with an illustrative embodiment of the present invention.

FIG. 3 shows a simplified block diagram of an illustrative apparatus for generating masked thresholds using a filter bank such as the illustrative filter bank of FIG. 2, in accordance with one illustrative embodiment of the present invention. The illustrative apparatus of FIG. 3 is based in particular on the psychophysiological model described in "Evaluation of a Physiological Ear Model Considering Masking Effects Relevant to Audio Coding," cited above. The cochlear filters of the model as described therein are advantageously replaced by a filter bank in accordance with the principles of the present invention, such as, for example, the illustrative filter bank of FIG. 2.

Specifically, the input acoustic signal is advantageously preprocessed by outer and middle ear (OME) filter 31, which approximates the filter characteristic of these parts of the auditory system. OME filter 31 is conventional. (See, e.g., "Evaluation of a Physiological Ear Model Considering Masking Effects Relevant to Audio Coding," cited above.) The output signal of OME filter 31 is then spectrally decomposed by filter bank 32, which approximates the frequency dependent spread of masking. Filter bank 32 is illustratively the filter bank shown in FIG. 2 and described above. The envelope of each band-pass signal as produced by filter bank 32 is approximated by rectification and low-pass filtering. In particular, the amount of envelope fluctuation is estimated by fluctuation measure module 34 and used by threshold level adjustment module 35 to adjust the masked threshold level by subtracting a fluctuation dependent offset from the envelope level as determined by envelope generation module 33. For high fluctuations the masked threshold may advantageously be assumed to have a higher level than for low fluctuations at the same envelope level. This property is related to the asymmetry of masking, familiar to those skilled in the art, which some models have take into account by a tonality estimation. Finally, temporal smearing is applied by temporal smearing module 36 to the offset adjusted thresholds in order to take properties of temporal masking (e.g., pre- and post-masking) into account. The smearing is motivated by the fact that temporal masking is mainly created in the auditory system after the cochlear filtering has been performed.

The aim of the model as illustratively shown in FIG. 3 is to derive the masked threshold level at the output of each channel for an assumed probe at the center frequency of that channel. The desired frequency responses of the filter bank may be advantageously derived from masking patterns of narrow-band noise maskers. For this type of masker, the envelope fluctuation at the filter outputs may be advantageously assumed to be at the upper bound. Due to the stationary masker, temporal masking effects can be neglected and the output masked threshold of the model depends mainly on the filter bank and OME filter characteristic.

Due to the asymmetric frequency spread of masking, a probe at a higher frequency than the masker frequency is exposed to a larger masking effect than a probe at a lower frequency. This asymmetry can be advantageously modeled by a filter that produces more attenuation for a masker above the center frequency than for a masker below the center frequency. Thus, the band-pass filter slopes are advantageously asymmetrical with a more shallow slope towards lower frequencies. In simple masking models, which may be adopted in accordance with certain illustrative embodiments of the present invention, masking patterns may be described by two constant slopes on a level vs. Bark scale. (The Bark scale, which represents the filtering process of the human ear—approximately linear at frequencies less than approximately 1 kilohertz and approximately logarithmic at frequencies greater than approximately 1 kilohertz—is fully familiar to those of ordinary skill in the art.) In accordance with one illustrative embodiment of the present invention, these slopes are advantageously chosen to be 8 dB/Bark and −25 dB/Bark. Whereas, in accordance with some illustrative embodiments of the present invention, the filter bank center frequencies may be distributed in accordance with the Bark scale, in accordance with certain other illustrative embodiments of the present invention, the Bark scale may be advantageously approximated by a logarithmic frequency scale for purposes of simplicity. (As pointed out above, such an approximation is in good agreement with psychophysical data for frequencies above 1 kilohertz.)

Thus, in accordance with one illustrative embodiment of the present invention, the desired filter bank center frequencies are advantageously distributed uniformly on a logarithmic scale, covering the full range of audible frequencies. The spacing is illustratively set to a quarter of a critical band and the critical band width is advantageously assumed to be equal to 20% of the center frequency. Thus, the filter with center frequency $f_c(k)$ of channel k is related to channel k−1 by Eq. (1) below. (In accordance with certain illustrative embodiments of the present invention, coarser critical band spacings may be employed. However a significantly coarser critical band spacing would necessitate a higher LPF order to maintain the slope steepness $S_{LP}$.) The desired magnitude frequency response |H(f)| of one channel with the cutoff at $f_c$ is defined in Eq. (2) below.

$$f_c(k)=1.2^{-1/4}f_c(k-1) \tag{1}$$

$$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|. \tag{2}$$

where $j=\sqrt{-1}$.

Note that the first term in Eq. (2) describes the steep filter slope towards high frequencies with a steepness of $S_{LP}$. The low frequency slope is determined by the second term of Eq. (2) and has a steepness of $S_{HP}$. The transition between the two slopes is controlled by a resonance quality factor q. In accordance with one illustrative embodiment of the present invention, the values of $S_{LP}$, $S_{HP}$, and q, are advantageously set as follows:

$$S_{LP} = \frac{-25}{20\log_{10}\left(\frac{1}{1.2}\right)};\ S_{HP} = \frac{-8}{20\log_{10}\left(\frac{1}{1.2}\right)};\ \text{and}\ q=4.$$

In accordance with certain illustrative embodiments of the present invention, in order to minimize computational complexity, the LPFs and HPFs may be advantageously realized as IIR filters. Additional advantages of IIR filters over FIR filters consist of the reduced group delay and a phase response which is better matched to the auditory system. Given the desired frequency responses, the filter coefficients of such illustrative IIR filters can be advantageously optimized using standard techniques, familiar to those skilled in the art, such as, for example, the damped Gauss-Newton method for iterative search, software for which is generally available. As pointed out above, a reasonably good approximation of the desired responses may be achieved with use of an HPF order of 4 and an LPF order of 2.

Figure 4:
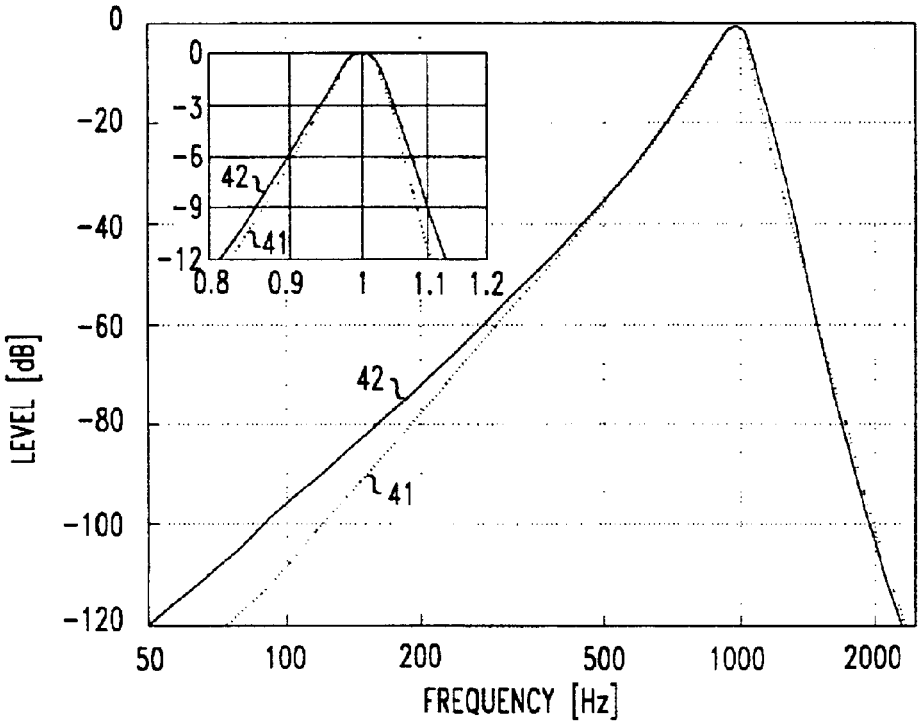
FIG. 4 shows a desired and a resulting magnitude frequency response of a particular illustrative filter having a center frequency of 1002 Hertz in accordance with one illustrative embodiment of the present invention.

FIG. 4 shows a desired and a resulting magnitude frequency response of a particular illustrative filter having a center frequency of $f_c$ =1002 Hertz (Hz) in accordance with one illustrative embodiment of the present invention. The dashed line 41 represents the desired magnitude response and the solid line 42 represents the achieved magnitude response of the illustrative filter. The inset shows in finer detail the response near the center frequency. The input audio sampling frequency is 44.1 kilohertz.

Note that near the center frequency, $f_c$, the deviation is small. At low frequencies, the deviation reaches about 10 dB at 100 Hz. However, due to the high damping in this frequency range far from the center frequency, this deviation may be considered to have only minor effects for applications such as audio coding. In accordance with certain illustrative embodiments of the present invention, the distribution of the approximation error can be advantageously controlled by using a frequency dependent weighting function for the error in the optimization algorithm. Such weighting functions are conventional and will be fully familiar to those of ordinary skill in the art.

Figure 5:
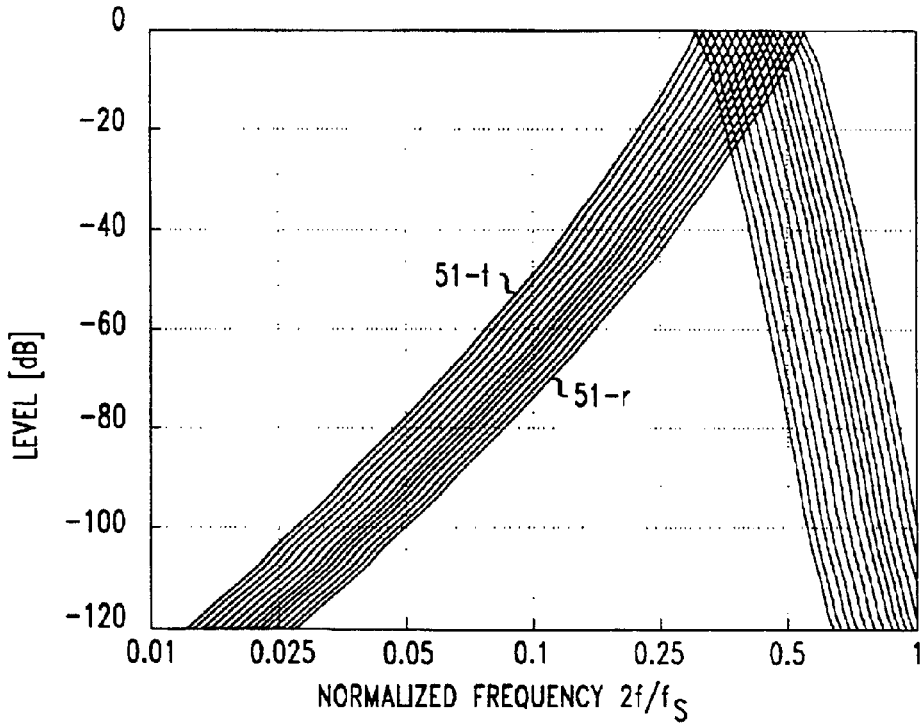
FIG. 5 shows an illustrative set of resulting magnitude frequency responses of the filter bank channels in stage 2 of the illustrative filter bank of FIG. 2 in accordance with one illustrative embodiment of the present invention.

FIG. 5 shows an illustrative set of resulting magnitude frequency responses of the filter bank channels in stage 2 of the illustrative filter bank of FIG. 2 in accordance with one illustrative embodiment of the present invention. In particular, curves 51-r through 51-t show illustrative magnitude frequency responses for illustrative filter bank sections 23-r through 23-t, respectively, as are shown in FIG. 2. Note that the frequency scale is normalized by half the sampling frequency of that stage. Note also that the responses have basically the same shape on a logarithmic scale—they are shifted according to their center frequency and are highly overlapping.

Figure 6:
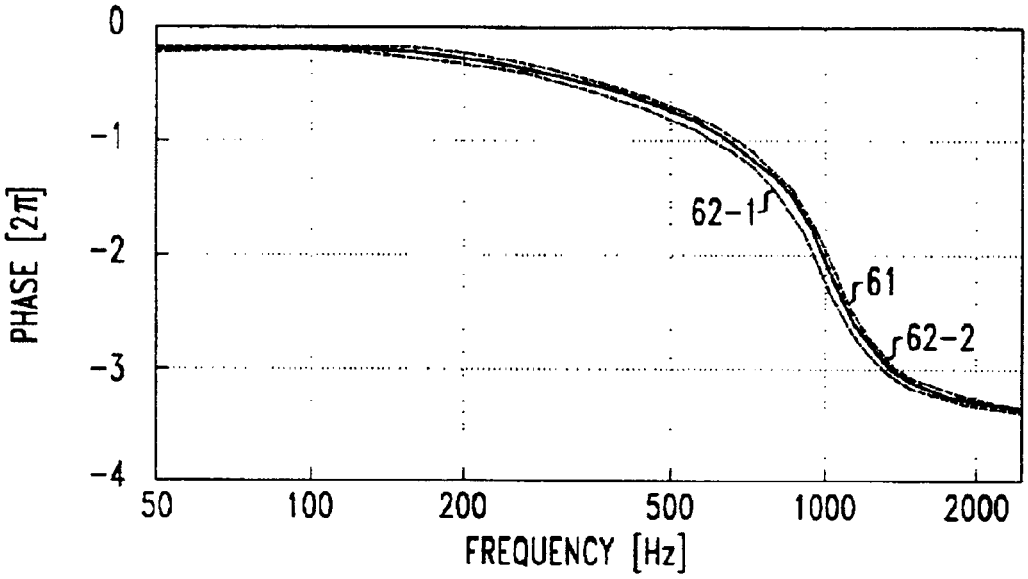
FIG. 6 shows illustrative phase responses of a particular illustrative filter having a center frequency of 1002 Hz and its neighboring filter bank channels in accordance with one illustrative embodiment of the present invention.

FIG. 6 shows illustrative phase responses of a particular illustrative filter having a center frequency of 1002 Hz and its neighboring filter bank channels in accordance with one illustrative embodiment of the present invention. The solid line 61 shows an illustrative phase response for the illustrative filter centered at 1002 Hz and the dashed lines 62-1 and 62-2 show illustrative phase responses for the filter bank channels which are the immediate neighbors thereof. These phase responses were determined by the minimum phase design of all LPFs and HPFs, which, in accordance with the given illustrative embodiment of the present invention, is advantageously chosen in accordance with known models of cochlear hydromechanics. Thus, the phase qualitatively agrees with measurements of basilar membrane motion in the cochlea. (See, e.g., M. A. Ruggero et al., "Basilar-Membrane Responses to Tones at the Base of the Chinchilla Cochlea," J. Acoust. Soc. Am., 101(4), pp. 2151–2163, 1997.)

Figure 7:
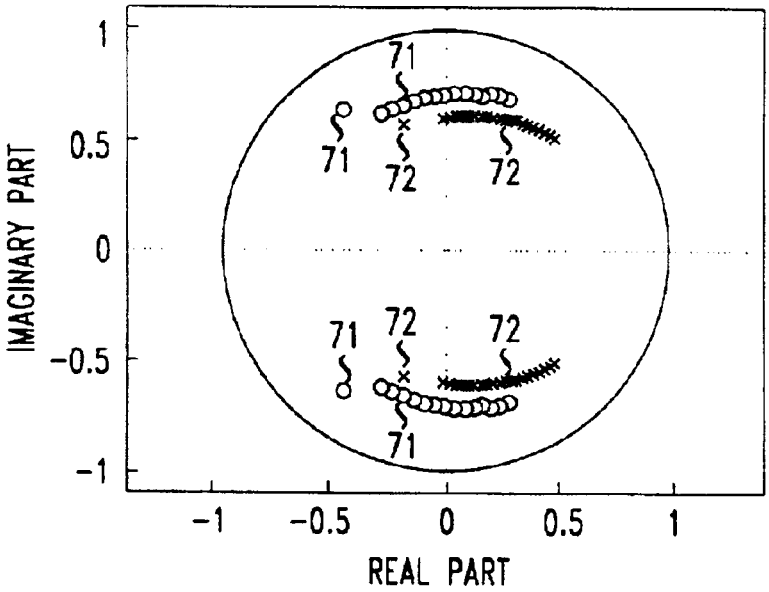
FIG. 7 shows an illustrative location of the low-pass filter poles and zeros in stage 2 of the illustrative filter bank of FIG. 2 in accordance with one illustrative embodiment of the present invention.

FIG. 7 shows an illustrative location of the LPF poles and zeros in stage 2 of the illustrative filter bank of FIG. 2 in accordance with one illustrative embodiment of the present invention. In the figure, "o" characters are used to represent the zeros 71 and "x" characters are used to represent the poles 72. Note that, advantageously due to the distance of the poles and zeros from the unit circle, implementation problems which could be caused by limited arithmetic precision are unlikely.

Figure 8:
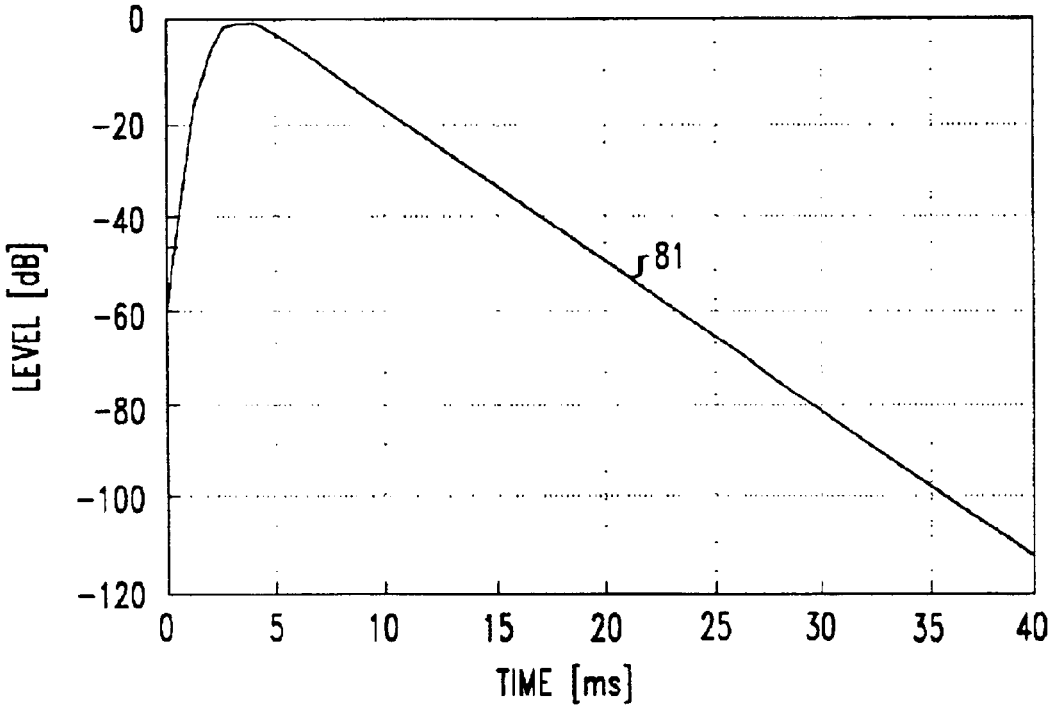
FIG. 8 shows the logarithm of an impulse response envelope for a particular illustrative filter having a center frequency of 1002 Hertz in accordance with one illustrative embodiment of the present invention.

FIG. 8 shows an impulse response envelope for a particular illustrative filter having a center frequency of 1002 Hz in accordance with one illustrative embodiment of the present invention. The impulse response is shown on a logarithmic scale as curve 81. The modeling of temporal masking requires that the temporal spread of a filter which is reflected by its impulse response does not exceed the limits of pre- and post-masking. Pre-masking is generally considered to last for a few milliseconds (ms) before a masker is switched on. The temporal filter response is in the same time range, since it reaches the maximum after 3 ms. Post-masking can last for approximately 200 ms after a masker is switched off. Since the temporal filter response of the illustrative filter shows a damping of more than 100 dB after 36 ms from the maximum, it can be seen that it advantageously fulfills these conditions.

Note that the time needed for the envelope to fall below a given threshold decreases with increasing filter center frequency. This duration is approximately inversely proportional to the center frequency. Thus, the filter responses above 1002 Hz do not exceed the limits of temporal masking. The time for reaching the impulse response maximum exceeds 3 ms at center frequencies well below 1002 Hz. It may be assumed that pre-masking duration increases at lower frequencies as well, so that the pre-masking duration is advantageously not exceeded.

Figure 9:
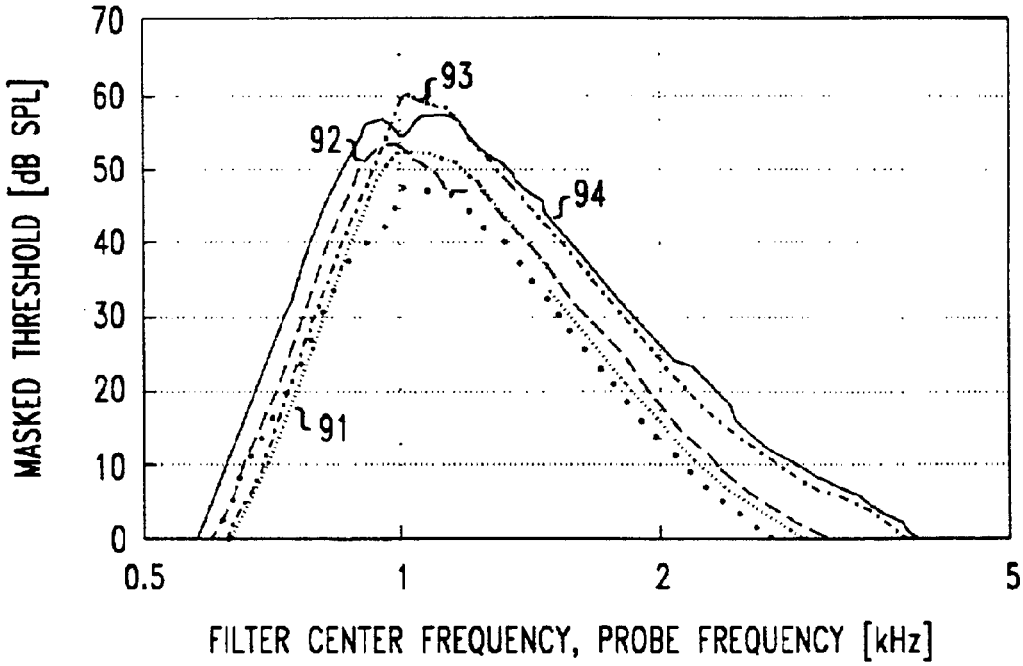
FIG. 9 shows illustrative results from the illustrative apparatus of FIG. 3 for the masked threshold of an illustrative 160 Hertz wide Gaussian noise masker centered at 1 kilohertz in accordance with one illustrative embodiment of the present invention.

FIG. 9 shows illustrative results from the illustrative apparatus of FIG. 3 for the masked threshold of an illustrative 160 Hz wide Gaussian noise masker centered at 1 kilohertz in accordance with one illustrative embodiment of the present invention. The four different masking curves—curves 91, 92, 93 and 94—represent randomly selected samples from different time instances and reflect the fluctuating nature of the masker The masked threshold at the output of each model channel is assigned to the channel center frequency. For example, a probe signal at a channel center frequency is assumed to be inaudible, if its level is below the calculated masked threshold.

Addendum to the Detailed Description

It should be noted that all of the preceding discussion merely illustrates the general principles of the invention. It will be appreciated that those skilled in the art will be able to devise various other arrangements which, although not explicitly described or shown herein, embody the principles of the invention and are included within its spirit and scope. For example, filter banks in accordance with the principles of the present invention can be adapted to applications that require frequency responses different from the examples described above. This flexibility also permits different frequency spacings or bandwidths by defining the appropriate desired frequency response H(f) for each filter channel. Thus the proposed filter bank structure provides a flexible framework for approximating the auditory time and frequency resolution in different applications.

Furthermore, all examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future—i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown.

The functions of the various elements shown in the figures, including functional blocks labeled as "processors" or "modules" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read-only memory (ROM) for storing software, random access memory (RAM), and non-volatile storage. Other hardware. conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof any element expressed as a means for performing a specified function is intended to encompass any way of performing that function including, for example, (a) a combination of circuit elements which performs that function or (b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent (within the meaning of that term as used in 35 U.S.C. 112, paragraph 6) to those explicitly shown and described herein.

I claim:

1. A method for determining a plurality of masked thresholds for a perceptual auditory model based on an input audio signal, the method comprising the steps of:

filtering the input audio signal with use of a filter bank comprising a plurality of filter bank stages connected in series, each filter bank stage comprising a plurality of low-pass filters connected in series and a corresponding plurality of high-pass filters applied to a corresponding output from each of said low-pass filters, said filter bank further comprising a plurality of downsamplers connected in series between each successive pair of filter bank stages, each of said high-pass filters comprised in each of said filter bank stages producing a corresponding band-pass signal as an output thereof; and generating, for each of said band-pass signals, a corresponding masked threshold based thereon, wherein each of said band-pass signals has a corresponding center frequency associated therewith, and wherein said center frequencies associated with each of said band-pass signals, when placed in an ascending numerical sequence, are related to one another in accordance with a substantially logarithmic frequency scale and wherein said center frequencies associated with each of said band-pass signals, when placed in said ascending numerical sequence, $f_c(1)$, . . . , $f_c(k)$, . . . , are related to one another substantially in accordance with $f_c(k)=1.2^{-1/4}f_c(k-1)$.

2. The method of claim 1 wherein each of said low-pass filters and each of said high-pass filters comprises an IIR filter.

3. The method of claim 2 wherein each of said low-pass filters comprises a second order IIR filter and wherein each of said high-pass filters comprises a fourth order IIR filter.

4. The method of claim 1 wherein filter coefficients of each of said low-pass filters and filter coefficients of each of said high-pass filters are based on a set of desired magnitude frequency responses.

5. The method of claim 4 wherein said filter coefficients have been optimized to match said set of desired magnitude frequency responses with use of a damped Gauss-Newton method.

6. The method of claim 4 wherein said set of desired magnitude frequency responses is based on a frequency response of the human auditory system.

7. The method of claim 1 wherein each of said downsamplers performs a downsampling of an input signal thereto by a rate reduction factor of two.

8. The method of claim 1 wherein said filter bank comprises approximately nine filter bank stages, wherein a first one of said filter bank stages comprises approximately 25 low-pass filters and approximately 25 high-pass filters, and wherein each filter bank stage other than said first one of said filter bank stages comprises approximately 15 low-pass filters and approximately 15 high-pass filters.

9. The method of claim 1 wherein each of said band-pass signals has a corresponding center frequency associated therewith, and wherein said center frequencies associated with each of said band-pass signals, when placed in an ascending numerical sequence, are related to one another in accordance with a Bark scale.

10. The method of claim 1 wherein each of said band-pass signals also has a corresponding desired magnitude frequency response associated therewith, and wherein, for each of said band-pass signals, said corresponding desired magnitude frequency response, |H(f)|, associated with the band-pass signal having an associated center frequency of $f_c$ is defined in accordance with $$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|,$$

$$\text{where } j=\sqrt{-1},\ S_{LP}=\frac{-25}{20\log_{10}\left(\frac{1}{1.2}\right)},$$

$$S_{HP}=\frac{-8}{20\log_{10}\left(\frac{1}{1.2}\right)},\ \text{and } q=4.$$

11. An apparatus for determining a plurality of masked thresholds for a perceptual auditory model based on an input audio signal, the apparatus comprising:

a filter bank applied to the input audio signal, the filter bank comprising a plurality of filter bank stages connected in series, each filter bank stage comprising a plurality of low-pass filters connected in series and a corresponding plurality of high-pass filters applied to a corresponding output from each of said low-pass filters, said filter bank further comprising a plurality of downsamplers connected in series between each successive pair of filter bank stages, each of said high-pass filters comprised in each of said filter bank stages producing a corresponding band-pass signal as an output thereof; and a masked threshold generator which generates, for each of said band-pass signals, a corresponding masked threshold based thereon, wherein each of said band-pass signals has a corresponding center frequency associated therewith, and wherein said center frequencies associated with each of said band-pass signals, when placed in an ascending numerical sequence, are substantially related to one another in accordance with a substantially logarithmic frequency scale and wherein said center frequencies associated with each of said band-pass signals, when placed in said ascending numerical sequence, $f_c(1), \ldots, f_c(k), \ldots$, are related to one another substantially in accordance with $f_c(k)=1.2^{-1/4}f_c(k-1)$.

12. The apparatus of claim 11 wherein each of said low-pass filters and each of said high-pass filters comprises an IIR filter.

13. The apparatus of claim 12 wherein each of said low-pass filters comprises a second order IIR filter and wherein each of said high-pass filters comprises a fourth order IIR filter.

14. The apparatus of claim 11 wherein filter coefficients of each of said low-pass filters and filter coefficients of each of said high-pass filters are based on a set of desired magnitude frequency responses.

15. The apparatus of claim 14 wherein said filter coefficients have been optimized to match said set of desired magnitude frequency responses with use of a damped Gauss-Newton method.

16. The apparatus of claim 14 wherein said set of desired magnitude frequency responses is based on a frequency response of the human auditory system.

17. The apparatus of claim 11 wherein each of said downsamplers performs a downsampling of an input signal a rate reduction factor of two.

18. The apparatus of claim 11 wherein paid filter bark comprises approximately nine filter bank stages, wherein a first one of said filter bank stages comprises approximately 25 low-pass filters and approximately 25 high-pass filters, and wherein each filter bank stage other than said first one of said filter bank stages comprises approximately 15 low-pass filters and approximately 15 high-pass filters.

19. The apparatus of claim 11 wherein each of said band-pass signals has a corresponding center frequency associated therewith, and wherein said center frequencies associated with each of said band-pass signals, when placed in an ascending numerical sequence, are related to one another in accordance with a Bark scale.

20. The apparatus of claim 11 wherein each of said band-pass signals also has a corresponding desired magnitude frequency response associated therewith, and wherein, for each of said band-pass signals, said corresponding desired magnitude frequency response, |H(f)|, associated with the band-pass signal having an associated center frequency of $f_c$ is defined in accordance with $$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|,$$

$$\text{where } j=\sqrt{-1},\ S_{LP}=\frac{-25}{20\log_{10}\left(\frac{1}{1.2}\right)},$$

$$S_{HP}=\frac{-8}{20\log_{10}\left(\frac{1}{1.2}\right)},\ \text{and } q=4.$$

21. A filter bank comprising:

a plurality of filter bank stages connected in series, each filter bank stage comprising a plurality of low-pass filters connected in series and a corresponding plurality of high-pass filters applied to a corresponding output from each of said low-pass filters, each of said high-pass filters comprised in each of said filter bank stages producing a corresponding band-pass signal as an output thereof; and a plurality of downsamplers connected in series between each successive pair of filter bank stages, wherein each of said band-pass signals has a corresponding center frequency associated therewith, and wherein said center frequencies associated with each of said band-pass signals, when placed in an ascending numerical sequence, are related to one another in accordance with a substantially logarithmic frequency scale and wherein said center frequencies associated with each of said band-pass signals, when placed in said ascending numerical sequence, $f_c(1), \ldots, f_c(k), \ldots$, are related to one another substantially in accordance with $f_c(k)=1.2^{-1/4}f_c(k-1)$.

22. The filter bank of claim 1 wherein each of said low-pass filters and each of said high-pass filters comprises an IIR filter.

23. The filter bank of claim 22 wherein each of said low-pass filters comprises a second order IIR filter and wherein each of said high-pass filters comprises a fourth order IIR filter.

24. The filter bank of claim 21 wherein filter coefficients of each of said low-pass filters and filter coefficients of each of said high-pass filters are based on a set of desired magnitude frequency responses.

25. The filter bank of claim 24 wherein said filter coefficients have been optimized to match said set of desired magnitude frequency responses with use of a damped Gauss-Newton method.

26. The filter bank of claim 24 wherein said set of desired magnitude frequency responses is based on a frequency response of the human auditory system.

27. The filter bank of claim 21 wherein each of said downsamplers performs a downsampling of an input signal thereto by a rate reduction factor of two.

28. The filter bank of claim 21 wherein said filter bank comprises approximately nine filter bank stages, wherein a first one of said filter bank stages comprises approximately 25 low-pass filters and approximately 25 high-pass filters, and wherein each filter bank stage other than said first one of said filter bank stages comprises approximately 15 low-pass filters and approximately 15 high-pass filters.

29. The filter bank of claim 21 wherein each of said band-pass signals has a corresponding center frequency associated therewith, and wherein said center frequencies associated with each of said band-pass signals, when placed in an ascending numerical sequence, are related to one another in accordance with a Bark scale.

30. The filter bank of claim 21 wherein each of said band-pass signals also has a corresponding desired magnitude frequency response associated therewith, and wherein, for each of said band-pass signals, said corresponding desired magnitude frequency response, $|H(f)|$, associated with the band-pass signal having an associated center frequency of $f_c$ is defined in accordance with $$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|,$$

$$\text{where } j=\sqrt{-1},\ S_{LP}=\frac{-25}{20\log_{10}\left(\frac{1}{1.2}\right)},$$

$$S_{HP}=\frac{-8}{20\log_{10}\left(\frac{1}{1.2}\right)}, \text{ and } q=4.$$

31. A method of filtering an input audio signal, the method comprising the steps of:

applying said input audio signal to a filter bank comprising a plurality of filter bank stages connected in series, each filter bank stage comprising a plurality of low-pass filters connected in series and a corresponding plurality of high-pass filters applied to a corresponding output from each of said low-pass filters, each filter bank stage further comprising a plurality of downsamplers connected in series between each successive pair of filter bank stages; and producing a corresponding plurality of band-pass signals as outputs of each of said high-pass filters comprised in each of said filter bank stages, wherein each of said band-pass signals has a corresponding center frequency associated therewith, and wherein said center frequencies associated with each of said band-pass signals, when placed in an ascending numerical sequence, are related to one another in accordance with a substantially logarithmic frequency scale and wherein said center frequencies associated with each of said band-pass signals when laced in said ascending numerical sequence, $f_c(1), \ldots, f_c(k), \ldots$, are related to one another substantially in accordance with $f_r(k)=1.2^{-1/4}f_c(k-1)$.

32. The method of claim 31 wherein each of said low-pass filters and each of said high-pass filters comprises an IIR filter.

33. The method of claim 32 wherein each of said low-pass filters comprises a second order IIR filter and wherein each of said high-pass filters comprises a fourth order IIR filter.

34. The method of claim 31 wherein filter coefficients of each of said low-pass filters and filter coefficients of each of said high-pass filters are based on a set of desired magnitude frequency responses.

35. The method of claim 34 wherein said filter coefficients have been optimized to match said set of desired magnitude frequency responses with use of a damped Gauss-Newton method.

36. The method of claim 34 wherein said set of desired magnitude frequency responses is based on a frequency response of the human auditory system.

37. The method of claim 31 wherein each of said downsamplers performs a downsampling of an input signal thereto by a rate reduction factor of two.

38. The method of claim 31 wherein said filter bank comprises approximately nine filter bank stages, wherein a first one of said filter bank stages comprises approximately 25 low-pass filters and approximately 25 high-pass filters, and wherein each filter bank stage other than said first one of said filter bank stages comprises approximately 15 low-pass filters and approximately 15 high-pass filters.

39. The method of claim 31 wherein each of said band-pass signals has a corresponding center frequency associated therewith, and wherein said center frequencies associated with each of said band-pass signals, when placed in an ascending numerical sequence, are related to one another in accordance with a Bark scale.

40. The method of claim 31 wherein each of said band-pass signals also has a corresponding desired magnitude frequency response associated therewith, and wherein, for each of said band-pass signals, said corresponding desired magnitude frequency response, |H(f)|, associated with the band-pass signal having an associated center frequency of $f_c$ is defined in accordance with $$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|,$$

$$\text{where } j=\sqrt{-1},\ S_{LP}=\frac{-25}{20\log_{10}\left(\frac{1}{1.2}\right)},$$

$$S_{HP}=\frac{-8}{20\log_{10}\left(\frac{1}{1.2}\right)},\ \text{and } q=4.$$

41. An apparatus for determining a plurality of masked thresholds for a perceptual auditory model based on an input audio signal, the apparatus comprising:

means for filtering the input audio signal, said means for filtering comprising a plurality of filter bank stages connected in series, each filter bank stage comprising a plurality of means for low-pass filtering connected in series and a corresponding plurality of means for high-pass filtering applied to a corresponding output from each of said means for low-pass filtering, said means for filtering further comprising a plurality of means for downsampling connected in series between each successive pair of filter bank stages, each of said means for high-pass filtering comprised in each of said filter bank stages producing a corresponding band-pass signal as an output thereof; and means for generating, for each of said band-pass signals, a corresponding masked threshold based thereon, wherein each of said band-pass signals has a corresponding center frequency associated therewith, and wherein said center frequencies associated with each of said band-pass signals, when placed in an ascending numerical sequence, are related to one another in accordance with a substantially logarithmic frequency scale and wherein said center frequencies associated with each of said band-pass signals when laced in said ascending numerical sequence, $f_c(1), \ldots, f_c(k), \ldots$, are related to one another substantially in accordance with $f_c(k)=1.2^{-1/4}f_c(k-1)$.

42. The apparatus of claim 41 wherein each of said means for low-pass filtering and each of said means for high-pass filtering are based on a set of desired magnitude frequency responses, and wherein said set of desired magnitude frequency responses is based on a frequency response of the human auditory system.

43. The apparatus of claim 41 wherein each of said means for downsampling performs a downsampling of an input signal thereto by a rate reduction factor of two.

44. The apparatus of claim 41 wherein said means for filtering comprises approximately nine filter bank stages, wherein a first one of said filter bank stages comprises approximately 25 means for low-pass filtering and approximately 25 means for high-pass filtering, and wherein each filter bank stage other than said first one of said filter bank stages comprises approximately 15 means for low-pass filtering and approximately 15 means for high-pass filtering.

45. The apparatus of claim 41 wherein each of said band-pass signals has a corresponding center frequency associated therewith, and wherein said center frequencies associated with each of said band-pass signals, when placed in an ascending numerical sequence, are related to one another in accordance with a Bark scale.

46. The apparatus of claim 41 wherein each of said band-pass signals also has a corresponding desired magnitude frequency response associated therewith, and wherein, for each of said band-pass signals, said corresponding desired magnitude frequency response, |H(f)|, associated with the band-pass signal having an associated center frequency of $f_c$ is defined in accordance with $$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|,$$

$$\text{where } j=\sqrt{-1},\ S_{LP}=\frac{-25}{20\log_{10}\left(\frac{1}{1.2}\right)},$$

$$S_{HP}=\frac{-8}{20\log_{10}\left(\frac{1}{1.2}\right)},\ \text{and } q=4.$$

47. A filter bank comprising:

a plurality of filter bank stages connected in series, each filter bank stage comprising a plurality of means for low-pass filtering connected in series and a corresponding plurality of means for high-pass filtering applied to a corresponding output from each of said means for low-pass filtering, each of said means for high-pass filtering comprised in each of said filter bank stages producing a corresponding band-pass signal as an output thereof; and a plurality of means for downsampling connected in series between each successive pair of filter bank stages, wherein each of said band-pass signals has a corresponding center frequency associated therewith, and wherein said center frequencies associated with each of said band-pass signals, when placed in an ascending numerical sequence, are related to one another in accordance with a substantially logarithmic frequency scale and wherein said center frequencies associated with each of said band-pass signals, when placed in said ascending numerical sequence, $f_c(1), \ldots, f_c(k), \ldots$, are related to one another substantially in accordance with $f_c(k)=1.2^{-1/4}f_c(k-1)$.

48. The filter bank of claim 47 wherein each of said means for low-pass filtering and each of said means for high-pass filtering are based on a set of desired magnitude frequency responses, and wherein said set of desired magnitude frequency responses is based on a frequency response of the human auditory system.

49. The filter bank of claim 47 wherein each of said means for downsampling performs a downsampling of an input signal thereto by a rate reduction factor of two.

50. The filter bank of claim 47 wherein said plurality of filter bank stages comprises approximately nine filter bank stages, wherein a first one of said filter bank stages comprises approximately 25 means for low-pass filtering and approximately 25 means for high-pass filtering, and wherein each filter bank stage other than said first one of said filter bank stages comprises approximately 15 means for low-pass filtering and approximately 15 means for high-pass filtering.

51. The filter bank of claim 47 wherein which of said band-pass signals has a corresponding center frequency associated therewith, and wherein said center frequencies associated with each of said band-pass signals, when placed in an ascending numerical sequence, are related to one another in accordance with a Bark scale.

52. The filter bank of claim 47 wherein each of said band-pass signals also has a corresponding desired magnitude frequency response associated therewith, and wherein, for each of said band-pass signals, said corresponding desired magnitude frequency response, |H(f)|, associated with the band-pass signal having an associated center frequency of $f_c$ is defined in accordance with $$|H(f)| = \left| \frac{1}{1+\left(\frac{f}{f_c}\right)^{S_{LP}}} \frac{\left(\frac{f}{f_c}\right)^{S_{HP}}}{1+\frac{j}{q}\left(\frac{f}{f_c}\right)^{\frac{S_{HP}}{2}}-\left(\frac{f}{f_c}\right)^{S_{HP}}} \right|,$$

where $j=\sqrt{-1}$, $S_{LP}=\frac{-25}{20\log_{10}\left(\frac{1}{1.2}\right)}$, $S_{HP}=\frac{-8}{20\log_{10}\left(\frac{1}{1.2}\right)}$, and $q=4$.

* * * * *